US005765454A

United States Patent [19]

Barbulescu et al.

[11] Patent Number: 5,765,454

[45] Date of Patent: Jun. 16, 1998

[54] TOOL HOLDER

[76] Inventors: Mihai Barbulescu, 172 Walnut Tree Hill Rd., Huntington, Conn. 06484; Lucian Manea, 117 North St., 7B, Seymour, Conn. 06483

[21] Appl. No.: 681,292

[22] Filed: Jul. 22, 1996

[51] Int. Cl.[6] ..... B25G 3/12; B25B 23/00

[52] U.S. Cl. ..... 81/487; 81/438; 81/177.1; 81/28

[58] Field of Search ..... 81/28, 487, 489, 81/155, 157, 158, 164, 175, 176, 491, 436–439, 125, 177.1, 177.2; 279/83; 408/239, 240; 206/376–379

[56] References Cited

U.S. PATENT DOCUMENTS

| | | | |
|---|---|---|---|
| 2,346,364 | 4/1944 | Dowe | 81/438 X |
| 2,443,339 | 6/1948 | Blalock | 81/28 |
| 2,810,415 | 10/1957 | Johnson | 81/28 |
| 3,850,056 | 11/1974 | Allen | 81/439 X |
| 4,709,602 | 12/1987 | Grabovac et al. | 81/172.1 X |
| 4,768,652 | 9/1988 | Fallon | 206/379 X |
| 5,138,917 | 8/1992 | Kirschner | 81/487 |
| 5,535,882 | 7/1996 | Liu | 206/376 X |

*Primary Examiner*—D. S. Meislin

*Attorney, Agent, or Firm*—Fattibene and Fattibene; Arthur T. Fattibene; Paul A. Fattibene

[57] ABSTRACT

A tool holder for holding tool bits, e.g. Allen wrenches or the like, that includes a tool head having a transversely extending hole for receiving a tool or tool bit and a connected stem having an internally threaded bore connected in communication with the transverse hole. A screw is threaded in the bore of the stem for securing and releasing the tool adapted to be received in the transverse hole. A handle having an internal seat is rotatable about the stem and connected screw and longitudinally movable relative thereto between a latched and unlatched position. In the latched position, the handle is freely rotatable relative to the stem and independently of the connected screw. In the unlatched position a seat in the handle engages the head of the screw whereby the rotation of the handle in one direction or the other effects the drive of the screw toward or away from the toolhead accordingly to either secure or release the tool bit. Included in combination with the tool holder is a magazine having a plurality of pockets for stowing various sized tool bits and a bracket connected to one side of the magazine for releasably stowing the tool holder on the magazine.

12 Claims, 3 Drawing Sheets

TOOL HOLDER

FIELD OF THE INVENTION

This invention is directed to a tool holder and more particularly to a manual tool holder for use with various sized tool bits, e.g. Allen wrenches and the like.

PROBLEM AND PRIOR ART

Heretofore, certain tools such as Allen wrenches, which vary in size, comprised a tool that was required to be manually used. That is, one end of the wrench was fitted to a complementary seat formed in the head of a screw or bolt and manually rotated in one direction or another to effect the driving moment of a screw or bolt. To repeatedly screw or unscrew screws or bolts with such Allen wrench type tool heretofore was a tedious and fatiguing operation.

SUMMARY OF THE INVENTION

An object of this invention is to provide a relatively simple tool holder for receiving various size tool bits within a predetermined range of sizes whereby the actuation of the tool bit is facilitated.

Another object is to provide a tool holder that can be adjustably fitted along the length of the tool bit so as to vary the amount of turning moment or torque applied to the tool bit.

Another object is to provide a tool holder which can be readily stowed on a magazine or storage container in which the tool bits are stored.

The foregoing objects and other features and advantages are attained by a tool holder formed with a tool head having a transversely extending hole or chuck for receiving a tool bit, e.g. an Allen type wrench. Connected to the tool head is a stem having an internally threaded bore which communicates with the transverse hole. A screw is threaded in the bore of the stem whereby the screw can be threaded toward or away from the transverse hole to secure or release the tool bit received therein.

A handle is rotatably journalled about the stem and associated screw, and longitudinally movable relative thereto toward and away from the tool head. Formed intermediate the ends of the handle is an internal seat adapted to engage the head of the screw when the handle is longitudinally shifted away from the tool head whereby the rotation of the handle effects the drive of the screw toward or away from the transverse hole to secure or release the tool bit.

With the tool bit locked with the transverse hole, the handle is latched onto the stem in an operative position whereby the seat within the handle is free of the screw and is rendered freely rotatably about the stem and operative to impart a turning moment or torque to the tool bit.

The respective tool bits may be stored in a magazine having a plurality of pockets for accommodating the respectively sized tool bits, and which magazine is provided with a bracket for releasably stowing the tool holder thereto when not in use.

IN THE DRAWINGS

DETAILED DESCRIPTION

Figure 2:
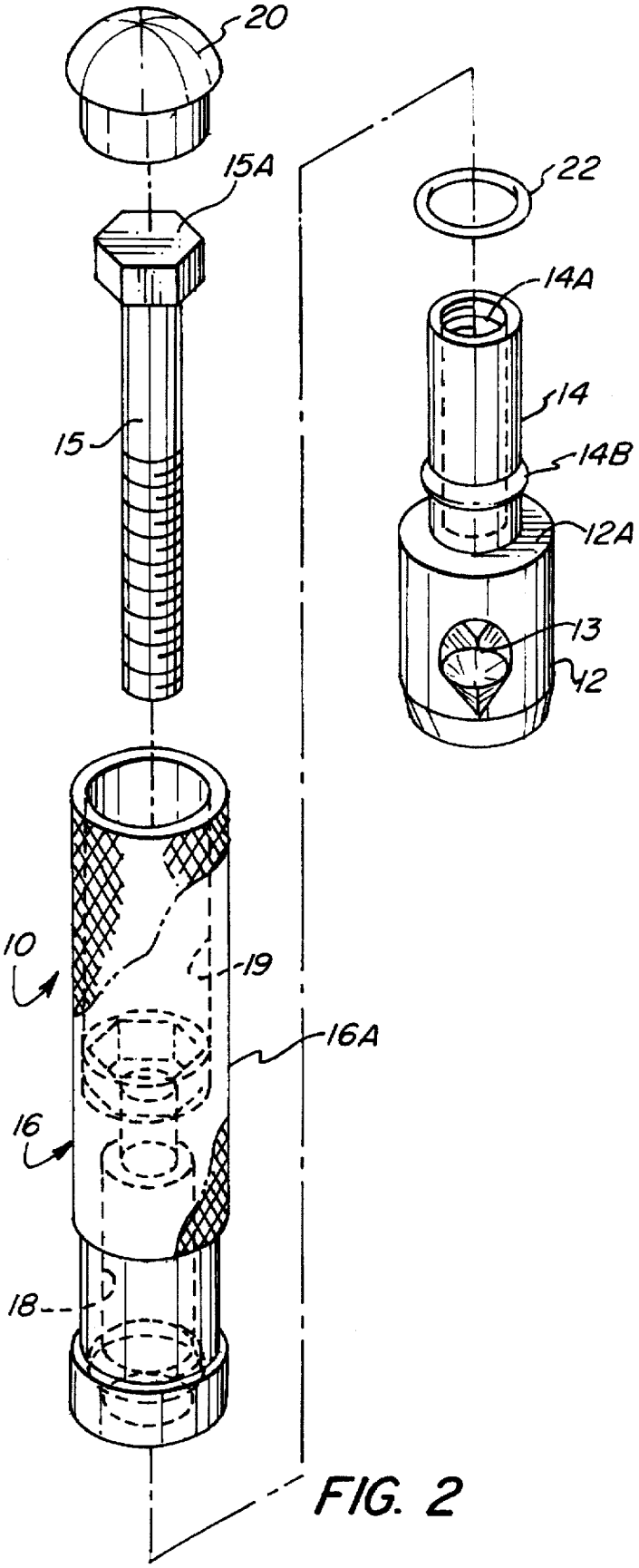
FIG. 2 is an exploded perspective view of the tool holder.
Figure 1:
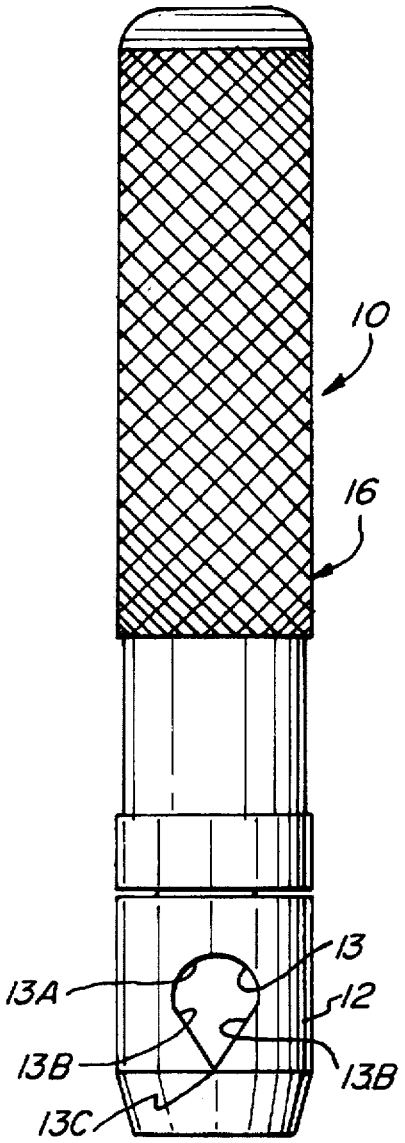
FIG. 1 is a side view of a tool holder embodying the invention.

Referring to the drawings, there is shown in FIGS. 1 and 2 a tool holder 10 embodying the present invention. The tool holder 10 is adapted for use with various size tool bits coming within a predetermined range of sizes. Tool bits as defined herein refers to various bits such as Allen type wrenches, screw driver bits, drill bits and the like. In the illustrated embodiment, the tool holder 10 is shown in FIG. 1 in combination with an Allen type wrench 11.

As illustrated, the Allen wrench 11 includes an elongated tool having a polygonic cross section with an angular offset arm portion 11A. The illustrated Allen wrench 11 is hexagonal in cross section.

The tool holder 10 includes a tool head 12 which is provided with a transversely extending hole 13 sized for receiving a tool, e.g. the longer arm 11B of an Allen wrench 11. It will be understood that the hole 13 is sufficiently large so as to receive various Allen wrench sizes that fall within a predetermined range of sizes. As best seen in FIG. 1, the hole 13 is semi-circular at one end 13A with tapering sides 13B opposite the semi-circular end that converges to a point or apex 13C, as shown. The apex 13C is formed to complement the opposed surfaces of a polygonically shaped tool 11 so that in use, the tool 11 is securely held or locked in place as will be described.

Connected to the tool head 12 and extending longitudinally thereof is a tubular stem 14. The stem 14 may be formed as an integral part of the tool head 12 and is provided within an internally threaded bore 14A which extends to the transverse hole 13 and communicating therewith. A laterally outwardly extending latching flange 14B circumscribes the stem and is longitudinally spaced a slight distance from the end face 12A of the tool head 12.

Figure 3:
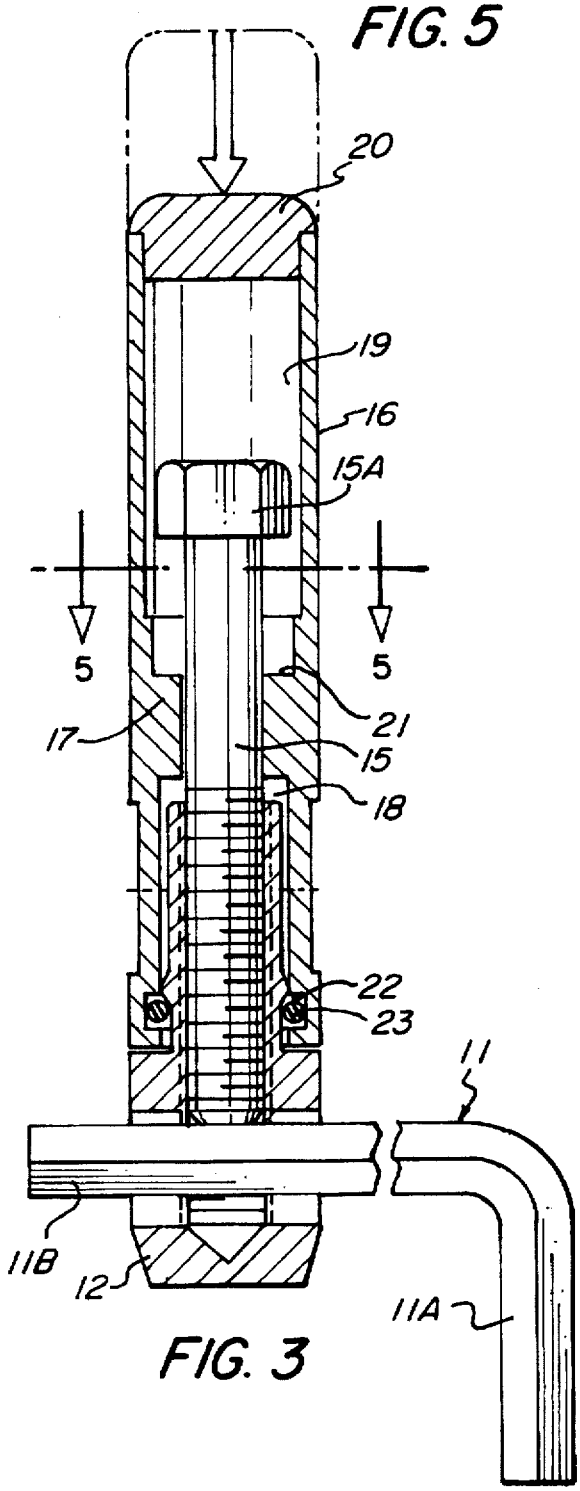
FIG. 3 is a sectional view illustrating the tool holder with attached tool bit in operative position for applying torque thereto.

A lock screw 15 is threaded to the threaded bore 14A of the stem 14. The arrangement is such that when the lock or locking screw 15 is rotated in one direction, the end of the screw 15 wedges against the tool bit or Allen wrench 11 to securely lock the wrench to the tool head 12, as best seen in FIG. 3. Rotation of the screw 15 in the opposite direction will release the wrench or tool bit 11 from the head 12. The other end of the screw 15 is provided with a screw head 15A of any given polygonic shape, e.g. square, hexagon, or the like.

Rotatably journalled about the stem 14 and associated screw 15 and longitudinally shiftable therealong is a handle 16. The handle 16 comprises an elongated sleeve 16A having an internal annular partition 17 defining a forward compartment 18 circumscribing the stem 14 and a rearward compartment 19 circumscribing the screw head 15A. An end plug 20 serves as a closure for the upper end of the handle 16. The portion of the rear chamber 19 adjacent the annular partition 17 is provided with a socket or seat 21 having an internal shape complementing the shape of the screw head 15A, e.g. hexagonal.

The end of the handle 16 adjacent the tool head 12 is provided with a circumscribing internal groove 22 to form a seat for a resilient "O" ring 23 which engages or circumscribes the portion of the stem 14 disposed between the face 12A of the tool head 12 and the latching flange 14B. The arrangement is such that the handle 16 may be longitudinally displaced relative to the stem 14 and associated screw 15 by the application of an axial force sufficient to force the "O" ring 23 over or past the latching flange 14B to a position shown in FIG. 4. With the handle latched as shown in FIG. 3, the handle 16 is free to rotate about the stem 14 and associated screw 15, without effecting the drive of the screw 15.

Figure 4:
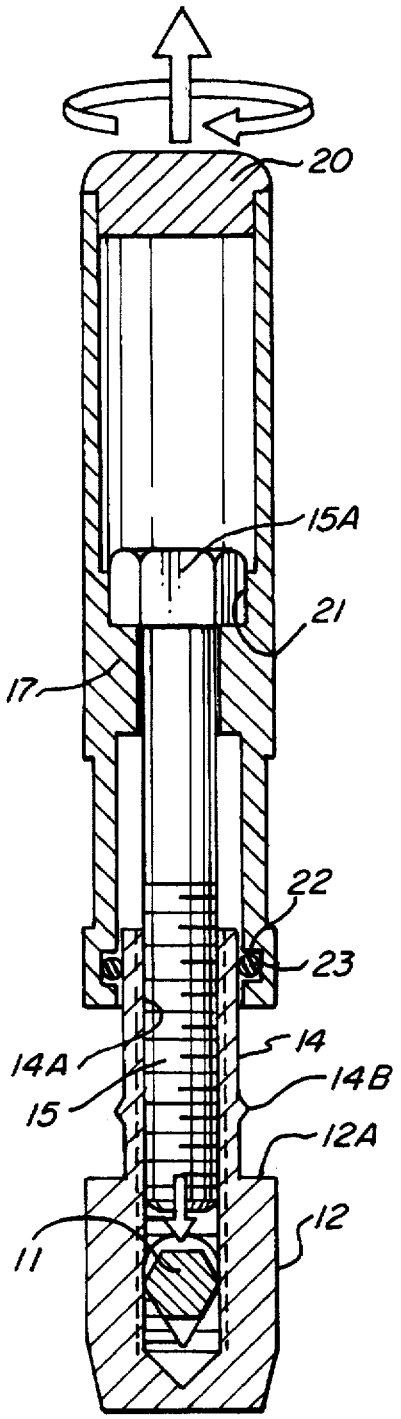
FIG. 4 is a sectional view similar to that of FIG. 3 illustrating the holder in position to effect the turning of the screw to release or secure the tool bit thereto.
Figure 5:
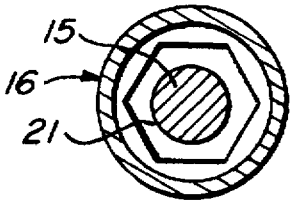
FIG. 5 is a sectional view taken along line 5—5 on FIG. 3.

When the tool holder 10 is to be used, a selected tool bit or wrench 11 is inserted into the transverse hole 13. The handle 16 is then shifted or unlatched to a position shown in FIG. 4 so that the seat 21 engages the head end 15A of the locking screw 15. Rotation of the handle 16 in one direction, as shown in FIG. 4, e.g. clockwise and with the screw head 15A seated in seat 21 causes the screw to be advanced toward the transverse hole 13 and tool bit 11 to securely lock and hold the tool bit or wrench 11 in place. The handle 16 is then longitudinally shifted toward the latched position as shown in FIG. 3. In this position, the handle 16 is rendered freely rotatable about the stem 14 and independent of the screw 15.

Figure 6:
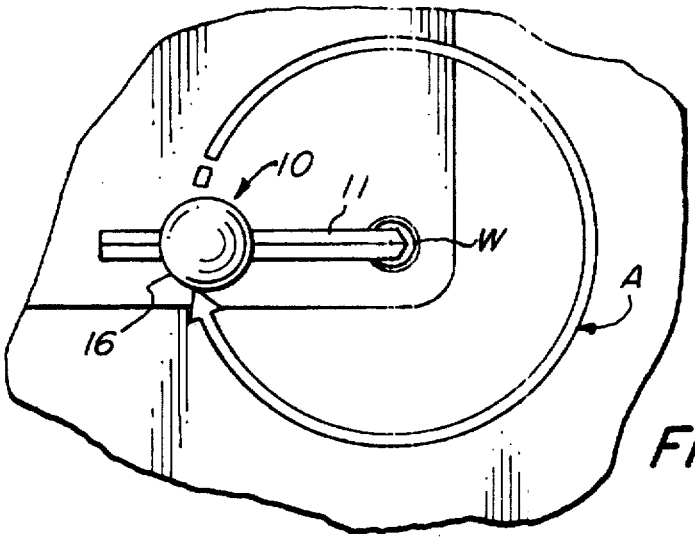
FIG. 6 is a plan view illustrating the operation of the tool holder.

With the tool bit or wrench 11 engaging a workpiece W or screw or bolt to be loosened as shown in FIG. 6, the handle 16 enables the tool bit or wrench 11 to be actuated or rotated to perform its function. As seen in FIG. 6, as the handle 16 is actuating or rotating the wrench 11 through an arch A, the handle 16 is also freely rotating about the axis of the tool head 12, thereby simplifying and facilitating the actuation of the tool bit or wrench 11.

As will be apparent in FIG. 6, a further advantage is achieved in that the tool holder 10 can be adjustably positioned along the long arm of the wrench 11 so as to increase or decrease the moment arm or torque force applied to the wrench 11, accordingly.

While not illustrated, it will be understood that the tool holder 10 may also be used with the screw drive bit, the drill bit, or like tool bits. When the holder 10 is used with a drill bit or screwdriver bit, the holder 10 becomes the torque arm of the tool bit, thereby applying an enhanced turning or torque moment to the drill bit or screw driver bit, not otherwise available with an ordinary screwdriver or hand drill driver where the turning moment is co-axial with the tool bit.

Figure 7:
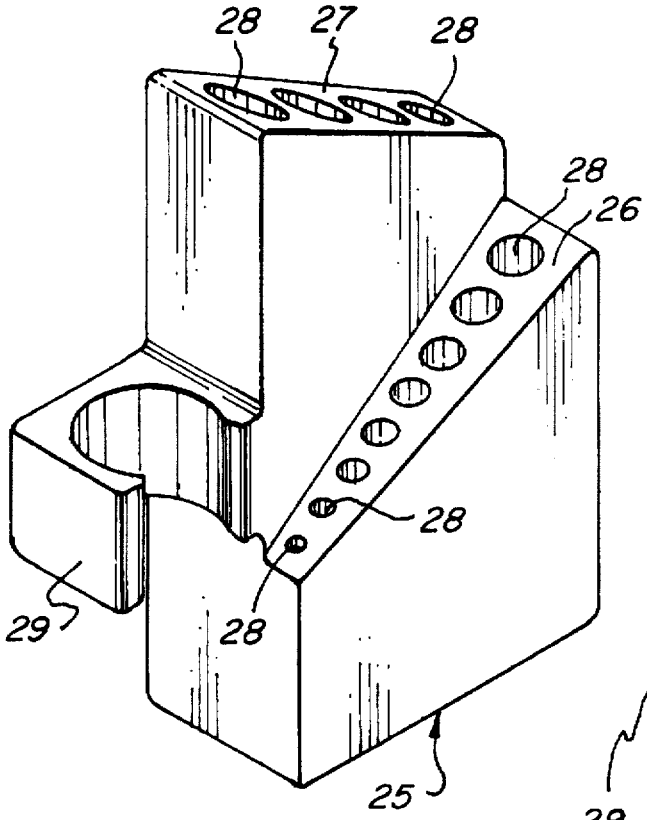
FIG. 7 is a perspective view of the tool bit storage magazine.
Figure 8:
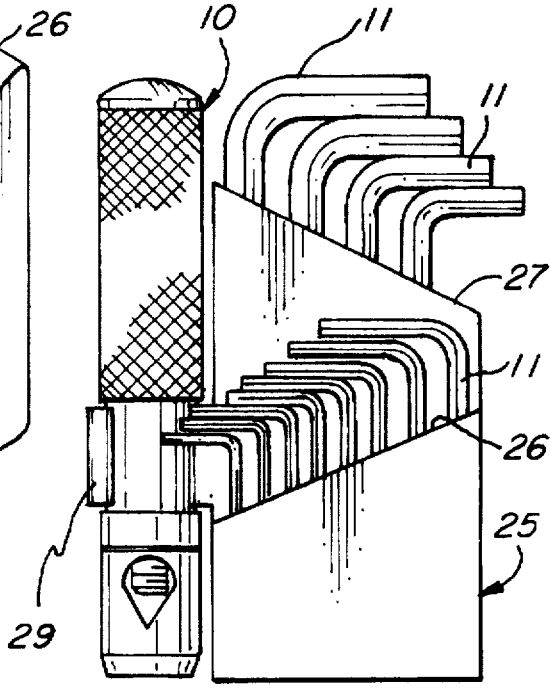
FIG. 8 is a side view of the tool holder in combination with a tool bit storage magazine.

FIG. 8 illustrates a tool bit storage magazine 25 and tool holder 10 combination. As illustrated, the storage magazine 25 is formed of a suitable material, e.g. plastic, in the form of a block shaped magazine having laterally offset step portions 26, 27. The offset step portions 26, 27 are each provided with a series or plurality of pockets 28 wherein the pockets 28 are progressively sized to receive a given sized tool bit or wrench 11 within a predetermined range of sizes, as shown in FIG. 7. Connected to one side of the magazine 25 is a resilient C shaped bracket 29 whereby the holder 10 may be releasably retained therein by a snap or friction fit. As seen in FIG. 8, the arrangement is such that the magazine 25, tool bits 11 and tool holder 10 are stowed in a compact manner so that the tool holder 10 and desired tool bits 11 are readily available for use and conveniently stowed when not in use. While FIG. 8 illustrates the magazine 25 as storage for Allen wrenches 11, it will be understood that other type tool bits, e.g. drill bits or the like, may be stowed therein.

While the present invention has been described with respect to a particular embodiment, modifications and variations may be made without departing from the spirit or scope of this invention.

What is claimed is:

1. A tool holder comprising a head having a transverse hole extending therethrough for receiving a tool, a stem connected to said head, said stem having a threaded bore disposed normal to and connected in communication with said transverse hole, a screw mating with said threaded bore for movement toward and away from said transverse hole for securing and releasing a tool adapted to be received in said hole, and a handle rotatably journalled about said stem and said screw and longitudinally movable relative thereto between a latched and unlatched position, and a seat formed intermediate the length of said handle internally thereof, a latching means for releasably latching said handle to said stem in said latched position whereby said handle is rendered freely rotatable relative to said stem and screw threaded thereto, and said screw includes a screw head shaped to engage with said seat in the unlatched position of said handle whereby rotation of said handle effects the drive of said screw toward or away from said transverse hole to secure or release a tool bit therein.

2. A tool holder as defined in claim 1 wherein said latching means includes a laterally extending collar on said stem, said collar being slightly spaced from said head, and a latching O-ring seated internally of said handle between said collar and said head in the latched position.

3. A tool holder as defined in claim 1 wherein said transverse hole has a configuration partly complementing the shape of the tool to be received therein.

4. A tool holder as defined in claim 1 wherein said transverse hole includes angular surfaces defining an acute angle therebetween adapted to complement corresponding angular surfaces of a tool adapted to be received therein.

5. A tool holder as defined in claim 1 wherein said screw includes a shank having a threaded portion threaded to said threaded bore, and a connected screw head, and said handle having a seat formed internally of said handle intermediate thereof for engaging said screw head in the unlatched position of said handle.

6. A tool holder as defined in claim 5 wherein said seat and screw head have complementary interfitting shapes.

7. A tool holder as defined in claim 1 wherein said hole is sized for receiving tools of varying diameters that fall within a predetermined range of diameters.

8. A combination comprising a tool holder and a tool for use therewith, said tool including an allen wrench having an elongated arm with an angularly disposed shorter arm, and said tool holder having a tool head having a hole extending transversely therethrough, a tubular stem connected to said tool head, said tubular stem having an internally threaded bore, a screw having a screw head and threaded shank threaded to said tubular stem, said bore being connected normal to and in communication with said transverse hole, and a handle in the form of an elongated barrel rotatably journalled about said stem and screw threaded thereto and longitudinally movable relative thereto, said barrel having a seat formed internally and intermediate of said barrel, said seat engaging said screw head when said barrel is longitudinally shifted to one position to effect the drive of said screw to effect the threading of said screw toward and away from said hole to lock or unlock the tool therein, and said seat disengaging with said screw head when said barrel is longitudinally shifted to a second position whereby said barrel is freely rotatable about said stem, and means for releasably latching said barrel to said stem whereby said barrel is rendered freely rotatable relative to said stem and screw threaded thereto in the latched position of said barrel.

9. A combination as defined in claim 8 wherein said transverse hole includes angular surfaces complementing said allen wrench adapted to be received therein.

10. A combination as defined in claim 8 wherein said latching means include a laterally extending collar on said stem and slightly spaced from said tool head, and an O-ring seated internally of said barrel between said tool head and said collar in the latched position of said barrel.

11. A combination as defined in claim 8 and including a storage magazine having a plurality of pockets formed therein, each said pocket being adapted to stow an allen wrench of predetermined given size, and a bracket disposed to one side of said magazine, said barrel of said tool holder being releasably connected to said bracket.

12. A tool holder comprising a tool head having a hole extending transversely therethrough, said hole being adapted to receive a tool, a stem connected to said tool head, said stem extending longitudinally of said tool head, an internal bore having a threaded position extending longitudinally of said stem, said bore being normal to and in communication with said hole, a screw having a threaded shank and a connected head end, said threaded shank being threaded to said threaded portion of said bore, and a handle rotatably journalled about said stem and longitudinally movable relative thereto between a first and second position, said handle having a seat intermediate the length thereof for accommodating the head end of said screw when said handle is longitudinally shifted to said first position to effect the turning of said screw relative to said threaded portion of said bore for advancing or retracting said screws toward or away from said hole to secure or release a tool received in said hole and when shifted to said second position, said handle is free to rotate independent of said screw.

* * * * *